US007946732B2

(12) United States Patent
Luo et al.

(10) Patent No.: US 7,946,732 B2
(45) **Date of Patent: *May 24, 2011**

(54) LED LAMP ASSEMBLY

(75) Inventors: Hong Luo, Danvers, MA (US); Zhoahuan Liu, Mississauga (CA)

(73) Assignee: Osram Sylvania Inc., Danvers, MA (US)

( * ) Notice: Subject to any disclaimer, the term of this patent is extended or adjusted under 35 U.S.C. 154(b) by 194 days.

This patent is subject to a terminal disclaimer.

(21) Appl. No.: 12/355,918

(22) Filed: Jan. 19, 2009

(65) Prior Publication Data

US 2010/0182788 A1 Jul. 22, 2010

(51) Int. Cl.
*F21V 29/00* (2006.01)

(52) U.S. Cl. ..... 362/294; 362/646; 362/652; 362/659

(58) Field of Classification Search ..... 362/241, 362/249.02, 294, 373, 646, 652, 657, 658, 362/659

See application file for complete search history.

(56) References Cited

U.S. PATENT DOCUMENTS

| | | | | |
|---|---|---|---|---|
| 6,827,469 | B2 | 12/2004 | Coushaine | |
| 6,880,962 | B2 | 4/2005 | Coushaine | |
| 7,086,767 | B2 | 8/2006 | Sidwell | |
| 7,121,687 | B2 | 10/2006 | Sidwell | |
| 7,261,437 | B2 | 8/2007 | Coushaine | |
| 7,703,941 | B2 * | 4/2010 | Lee | 362/652 |
| 2005/0237747 | A1 | 10/2005 | Shimizu et al. | |
| 2005/0276063 | A1 | 12/2005 | Coushaine et al. | |
| 2006/0262533 | A1 * | 11/2006 | Lin et al. | 362/249 |
| 2008/0074884 | A1 | 3/2008 | Mok et al. | |
| 2010/0181885 | A1 * | 7/2010 | Tessnow et al. | 362/294 |

FOREIGN PATENT DOCUMENTS

| | | | |
|---|---|---|---|
| EP | 1443562 | A2 | 8/2004 |
| EP | 1901406 | A1 | 3/2008 |

OTHER PUBLICATIONS

European Search Report and Annex for corresponding European Patent Application 10150227.6, mailed May 18, 2010, Applicant: Osram Sylvania, Inc.

* cited by examiner

*Primary Examiner* — Y My Quach Lee
(74) *Attorney, Agent, or Firm* — Willaim E. Meyer; Shaun P. Montana; Yiming Zhang

(57) ABSTRACT

A robust LED lamp may be assembly by forming a heat sinking sandwich with two metal heat sinks positioned around the circuit board and pinned together a heat conductive element. The assembly is positioned by pressing it into a base providing electrical connections. The robust assembly is rapidly assembled, thermally effective in draining or spreading heat from the circuit board and is readily adaptable to a variety of applications lighting. The heat sink may be decorated, colored or otherwise esthetically enhanced for consumer appreciation.

13 Claims, 2 Drawing Sheets

LED LAMP ASSEMBLY

CROSS-REFERENCE TO RELATED APPLICATIONS

Not applicable.

BACKGROUND OF THE INVENTION

1. Field of the Invention

The invention relates to electric lamps and particularly to LED electric lamps. More particularly the invention is concerned with LED lamps with heat sinks for rapid manufacture.

2. Description of the Related Art Including Information Disclosed Under 37 CFR 1.97 and 1.98

LED lamps are being developed as exterior vehicle light sources. A frequent problem is to dispose of the excess heat while at the same time protecting the LED light source or chip. One method is to use a flexible substrate and wrap the LED support onto a heat sinking body. The flexed substrate may not be reliable in manufacture, and actual use. The flexing and positioning of the substrate offers opportunities in manufacture for error in construction. Another method is to form some or all of the base with a heat sinking element, such as a metal core or similar heat transferring element. The most desirable place for the heat sink to extend to is the exterior and open air. This leads to base structures with enclosed heat sinks or heat sinks passing through the base to the outside. This requires co-molding, or some other method of constructing the multi-component base which can be expensive. This contrasts with filamented automobile lamps with molded plastic bases with staked in lamp sources and electrical connections. There is then a need for an LED lamp structure that is robust, easy to make and capable of distributing a substantial heat flow from one or more LEDs.

BRIEF SUMMARY OF THE INVENTION

An LED lamp assembly may be made with a planar circuit board having a substantially greater length and width than thickness, defining a first major side and a second major side. At least one LED is mounted on a major side of the circuit board. A sliding electrical contact is extended on or from an end of the circuit board. Electrical circuitry is supported on the circuit board, coupling the at least one LED to the sliding electrical contact. A first heat sink having a planar face is sized and shaped to substantially span and fit side by side to a major side of the circuit board. The heat sink includes one or more recesses or openings of sufficient size and shape to mechanically accommodate any adjacent electrical components formed on the circuit board, and includes at least one recess receiving the at least one LED permitting the transmission of light from the at least one LED to the exterior of the lamp assembly. The planar face of the first heat sink is mechanically positioned to be in close thermal contact with a major side of the circuit board. The circuit board and heat sink assembly form an axially extending body having substantially greater length and width than thickness, with the sliding electrical contact extending beyond the periphery of the first heat sink to be exposed for electrical connection. A base is mechanically coupled to the circuit board and heat sink assembly, and has at least one latching feature for mechanically coupling the lamp assembly in a lamp socket.

DETAILED DESCRIPTION OF THE INVENTION

Figure 1:
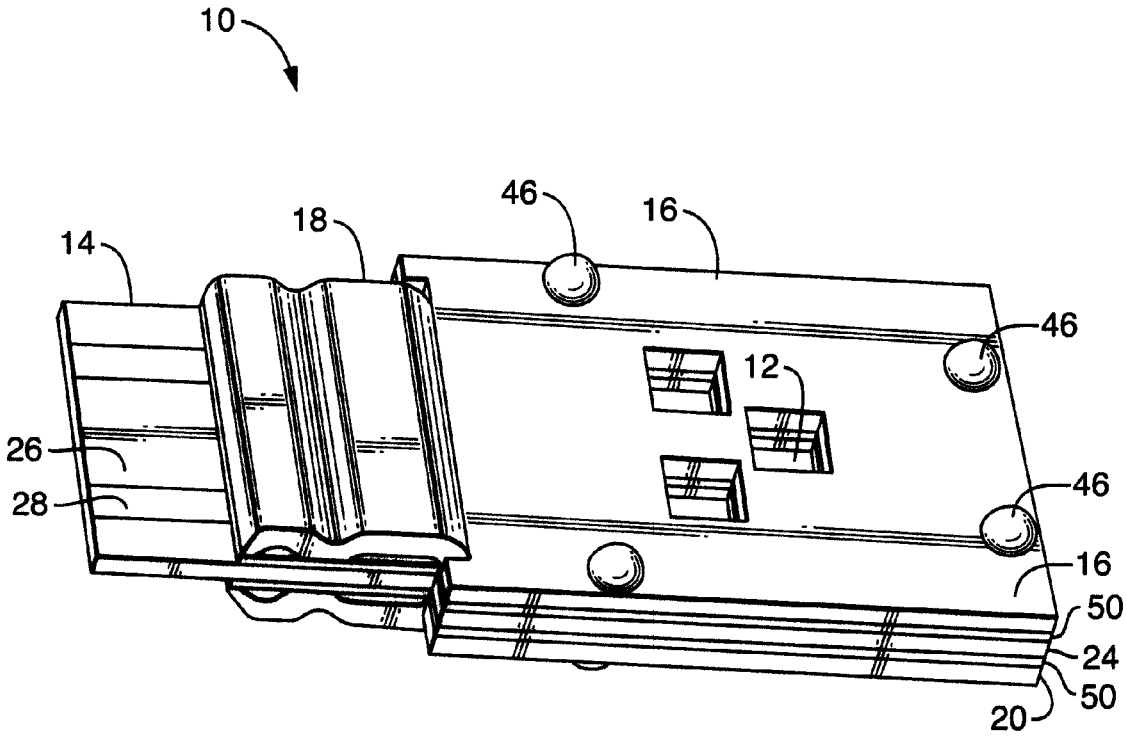
FIG. 1 shows a perspective view of a preferred embodiment of a LED Lamp Assembly.

FIG. 1 shows a perspective view of a preferred embodiment of an LED lamp assembly 10. The LED lamp assembly 10 is formed generally with at least one LED 12, a circuit board 14, a heat first sink 16, and a base 18 and an optional second heat sink 20. The preferred LED may be an LED enclosed in a carrier (TOPLED), or may be an open LED chip (chip on board).

Figure 2:
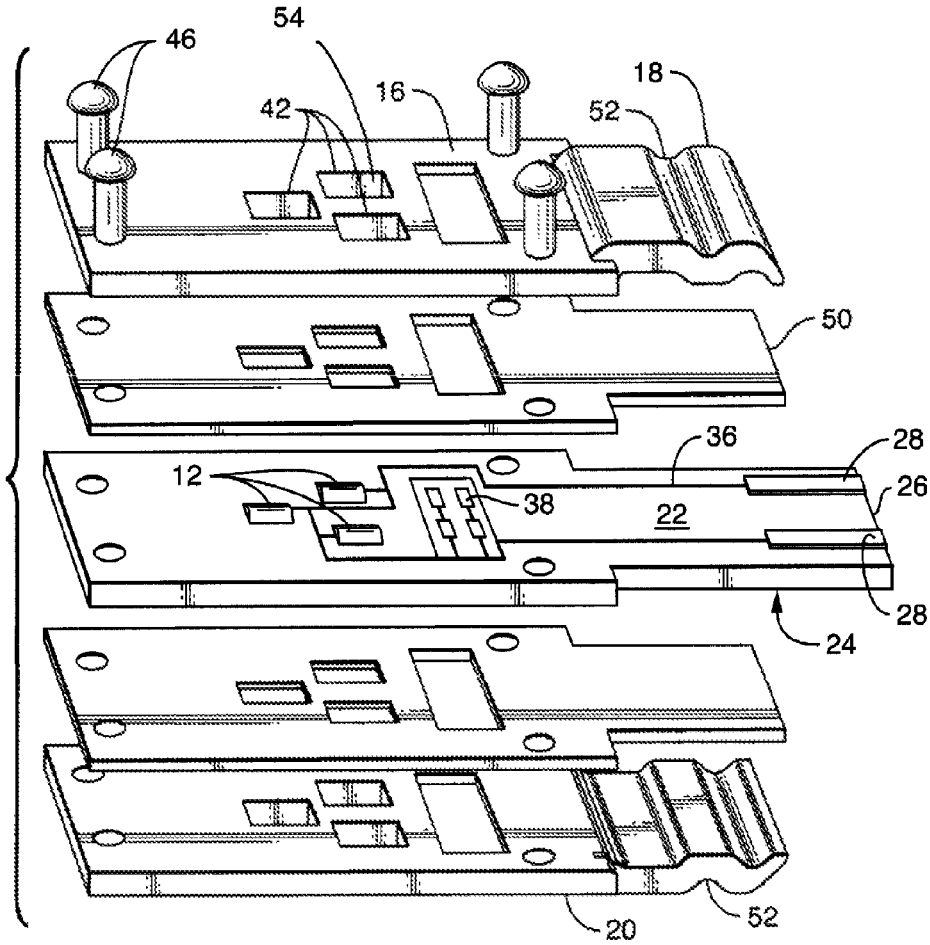
FIG. 2 shows an exploded view of a preferred embodiment of a LED Lamp Assembly.

FIG. 2 shows an exploded view of a preferred embodiment of an LED lamp assembly 10. The circuit board 14 is a planar circuit board 14 having a first major side 22 and a second major side 24. The preferred circuit board 14 is made from a heat conductive material, such as aluminum coated as needed with electrically insulating layers on one or both sides. The preferred circuit board 14 has a greater length and width than thickness and has the general form of an elongated rectangle. The circuit board 14 may be one typical of LED lamps supporting electrical circuits, having a heat conductive layer, electrically insulating layers, or patterns, and electrically conductive patterns for delivering electrical power to the LEDs and or other electrical devices mounted to the circuit board. In one embodiment the circuit board 14 was about 5.7 cm long, 2.6 cm wide and 1.57 mm thick.

At least one LED 12 is electrically coupled to the circuit board 14. Preferably a plurality of LEDs 12 is mounted on both the first major side 22 and the second major side 24 of the circuit board 14 to generally face in two directions. The LEDs 12 may be LED assemblies (TOPLEDs) mounted on the circuit board 14, or may be LED chips mounted directly on the circuit board 14 (chip on board). The preferred LEDs 12 all provide white light, but it is understood the LEDs may be of differing colors (red, blue, green, white) and the circuitry 36 may selectively illuminate individually or in combinations, the various LEDs 12 for differing purposes. For example, one set of LEDs may provide only white light, (back up lighting), an alternative set of LEDs may provide only red light (brake lighting), another set of LEDs may provide amber light for signaling or flashing functions (turn or warning) and so on.

Formed on an end of the circuit board 14 is an insertable tongue 26 with at least one sliding electrical contact 28. The sliding electrical contact 28 may be a metal pad or strip that extends axially from the edge of the circuit board 14 and should be thick enough to reliably form a sliding electrical contact 28 with a corresponding socket element to make an electrical connection to an electrical power source or any relevant signal control input. The sliding electrical contact 28 may comprise a copper trace formed on the surface of the circuit board 14.

Formed on the circuit board 14 may be electrical circuitry 36 and possibly including other related components 38 supported on the circuit board 14 and coupling the at least one LED 12 to the sliding electrical contact 28. In one embodiment, the circuitry 36 and components 38 provided a simple voltage step down from the typical 12 volts used in most vehicles.

The first heat sink 16 has a planar face that substantially abuts the first major side 22 of the circuit board 14. The preferred first heat sink 16 is made from metal, such as copper, aluminum or others and has the general form of an elongated rectangle similar in size and shape to the circuit board 14, albeit shorter or gapped at a base end so as to leave some or all of the tongue 26 and the sliding electrical contact 28 formed thereon exposed for electrical contact. In one embodiment the first heat sink 16 was made of aluminum and was 4.9 cm long, 2.6 cm wide and 1.74 mm thick leaving a tongue 26 of the circuit board 14 about (5.7 cm–4.9 cm=) 0.8 cm long uncovered and exposed for electrical connection. The first heat sink 16 is otherwise shaped to include one or more recesses or openings that span or fit corresponding LEDs 12 and electrical components 38 formed on the circuit board 14. The first heat sink 16 includes at least one open recess 42 for receiving the at least one LED 12. The open recess 42 permits the transmission of light from the at least one LED 12 to the exterior of the lamp assembly. The interior wall 54 defining the recess for the at least one LED may be shaped or provided with a reflective surface to direct light emitted from the LED in a preferred fashion, for example by having a parabola, or ellipse of revolution or similar shape with a mirrored surface. The planar face of the first heat sink 16 is mechanically positioned to be in close thermal contact with a major side of the circuit board 14. Heat from the circuit board 14, and heat from the at least one LED 12 is then substantially transmitted to the heat sink 16, where it is spread over a larger area, exposed to greater radiation or cooling effects and otherwise effectively removed from the circuit board 14 and or LED 12. The circuit board 14 and heat sink 16 form an axially extending body extending from the sliding electrical contact 28. The sliding electrical contact 28 extends beyond the periphery of the heat sink(s) 16, 20 to be exposed for electrical connection.

A similar second heat sink 20 may be mechanically coupled to the second major side 24 of the circuit board 14. The second heat sink 20 has a similar planar face that substantially abuts the second major side 24 of the circuit board 14. The first heat sink 16 and second heat sink 20 then sandwich the circuit board 14, capturing the circuit board 14 intermediate first heat sink 16 and the second heat sink 20. In a preferred embodiment, positioned intermediate the circuit board 14 and the first heat sink 16 is an insulating layer 50 to prevent electrical conduction from the circuit board 14 to the heat sink 16. The intermediate insulating layer 50 may be any of the known insulating coatings formed on the face of the circuit board or the face of the heat sink 16. Lacquers have been used. Alternatively, an intermediate sheet of electrically insulating material may be placed between the circuit board 14 and the heat sink 16 to prevent electrical conduction from the circuit board 14's first major side 22 and the planar face of the heat sink 16. The insulation is extended intermediate at least those regions of the circuit board 14 and the heat sink 16 that are directly opposite one another where both are electrically conductive. The preferred heat sink 16 (and 20) is further formed with a latching feature 52 such as a snap connection adjacent the tongue 26 and the sliding electrical contact 28 portions. The latching feature 52 may be shaped to fit known socket elements. In the preferred embodiment, the heat sink elements 16, 20 are formed with cavities or indentations that extend perpendicularly to the insertion direction of the sliding electrical contacts 28 to snap fit with a corresponding socket element.

The preferred first heat sink 16 and the second heat sink 20 are mechanically coupled one to the other through or around the circuit board 14. The first heat sink 16 and second heat sink 20 then press against the intermediate circuit board 14 for good thermal contact with the circuit board 14. The preferred first heat sink 16 and the second heat sink 20 are riveted with rivets 46 one to the other to press against the intermediate circuit board 14. The circuit board 14, or the first heat sink 16 and second heat sink 20 may have other formed end features adjacent the base, and assembly tongue 26 to enhance coupling and alignment of the circuit board 14 and heat sink 16, 20 assembly with the base 18. The exposed exterior surfaces of the heat sink 16, 20 may be modified for additional heat dispersion with ribs, fins, pins or similar feature, or may be colored or textured to aid heat radiation, improve light emission, decrease glare, decrease reflection or improve appearance (black, true color, white, silver, mirror reflective, dimpled, sand blasted, and so on).

A base 18 may be mechanically coupled to the circuit board 14 and heat sink assembly. A base 18 may be made from molded plastic of sufficient heat tolerance so as to accommodate the support of the LED circuit board 14 and heat sink 16, 20 assembly. The preferred base 18 was integrally formed as a portion of the heat sink, providing further heat sinking capacity. The preferred base 18 has the general form of a flat plate with a wedgable end adjacent the tongue end 26 portion of the circuit board 14, and a latching feature 52 transverse to the sliding contact 28. The integrally formed metal base 18 portions may be shaped or positioned to be offset from direct contact with circuit board, in which case the insulation layer need not extend to or beyond the edged of the heat sink 16, 20. The corresponding socket includes a slot shaped recess to receive the tongue 26 end of the circuit board 14, and heat sink assembly 16, 20 such as the base portion 18. The tongue 26 or base portion 18, as the case may be, and the slot recess may include formed latching and aligning features to receive and mechanically couple with the circuit board 14 and heat sink 16, 20 assembly. In one embodiment, the circuit board 14 and heat sink 16, 20 assembly had a base end formed as a flat tongue, and the socket recess was correspondingly formed with a slightly larger rectangular slot to enable the snug insertion (coupling) of the circuit board 14 and heat sink 16, 20 assembly in the socket. The latched mounting may be sized, shaped or keyed according to differing lamp structures and purposes, so that a tail assembly lamp may be similarly constructed as is a turn signal lamp assembly, but the two lamp types are distinctly keyed to prevent confused use in actual application.

While there have been shown and described what are at present considered to be the preferred embodiments of the invention, it will be apparent to those skilled in the art that various changes and modifications can be made herein without departing from the scope of the invention defined by the appended claims.

What is claimed is:

1. An LED lamp assembly comprising:

a planar circuit board having a substantially greater length and width than thickness, and having a first major side and a second major side, and the circuit board having a tongue end;

at least one LED mounted on a major side of the circuit board;

a sliding electrical contact extending on the tongue end;

electrical circuitry supported on the circuit board and coupling the at least one LED to the sliding electrical contact;

a first heat sink having a planar face sized and shaped to substantially span and fit, side by side, to a major side of the circuit board, the first heat sink including recesses or openings of sufficient size and shape to mechanically accommodate any adjacent electrical components formed on the circuit board, and including at least one recess receiving the at least one LED and permitting the transmission of light from the at least one LED to the exterior of the lamp assembly, the planar face of the first heat sink being mechanically positioned to be in close thermal contact with a major side of the circuit board;

the circuit board and the first heat sink forming an axially extending body having substantially greater length and width than thickness; and the tongue end and the sliding electrical contact extending beyond the periphery of the first heat sink to be exposed for electrical connection.

2. The LED lamp assembly in claim 1, further including a similar second heat sink mechanically coupled to the second major side of the circuit board, the first heat sink and second heat sink capturing the circuit board intermediate the first heat sink and the second heat sink.

3. The LED lamp assembly in claim 2, wherein the first heat sink and the second heat sink are mechanically coupled one to the other to press against the intermediate circuit board.

4. The LED lamp assembly in claim 3, wherein first heat sink and the second heat sink are riveted one to the other to press against the intermediate circuit board.

5. The LED lamp assembly in claim 1, wherein the sliding electrical contact comprises a metal pad coupled to the tongue end of the circuit board and is openly exposed for extension into a socket cavity.

6. The LED lamp assembly in claim 1, wherein the first heat sink is formed with a base portion, the base portion having a latching feature for mating with a socket for the lamp assembly.

7. The LED lamp assembly in claim 1, wherein the first heat sink is formed with a wall defining a recess to receive the at least one LED, and the wall is formed to reflect light from the at least one LED in a preferred fashion.

8. The LED lamp assembly in claim 1, wherein a first electrically insulating layer is positioned intermediate the circuit board and the first heat sink.

9. An LED lamp assembly comprising:

a planar circuit board having substantially greater length and width than thickness, and having a first major side and a second major side, and the circuit board having a tongue end;

at least one LED mounted on the circuit board;

an sliding electrical contact extending on the tongue end; the sliding electrical contact comprising lugs electrically coupled to the circuit board;

electrical circuitry and components supported on the circuit board and coupling the at least one LED to the sliding electrical contact;

a first heat sink having substantially greater length and width than thickness, and having a planar face, the first heat sink including recesses or openings sufficient to mechanically accommodate any corresponding electrical components formed on the circuit board, and including at least one recess receiving the at least one LED permitting the transmission of light from at least one LED to the exterior of the lamp assembly, the planar face of the first heat sink being mechanically positioned to be in close thermal contact with a major side of the circuit board; the circuit board and the first heat sink forming an axially extending body having substantially greater length and width than thickness;

a similar second heat sink mechanically coupled to the second major side of the circuit board, the first and second heat sinks capturing the circuit board intermediate the first heat sink and the second heat sink;

the first heat sink and the second heat sink mechanically coupled one to the other to press against the intermediate circuit board, the first heat sink and the second heat sink are riveted one to the other to press against the intermediate circuit board; wherein the sliding electrical contacts extend beyond the respective peripheries of the first heat sink and the second heat sink, exposed for electrical connection; and the tongue end and the sliding electrical contact extending beyond the peripheries of the first heat sink and the second heat sink to be exposed for electrical connection.

10. The LED lamp assembly in claim 9, wherein the first heat sink and the second heat sink are each formed with respective base portions, the base portions each having a latching feature for mating with a socket for the lamp assembly.

11. The LED lamp assembly in claim 9, wherein the first heat sink and the second heat sink are each formed from metal, and are integrally formed with respective metal base portions, the base portions each having a latching feature for mating with a socket for the lamp assembly.

12. The LED lamp assembly in claim 9, wherein the first heat sink is formed with a wall defining a recess to receive the at least one LED, and the wall is formed to reflect light from the at least one LED in a preferred fashion.

13. The LED lamp assembly in claim 9, wherein a first electrically insulating layer is positioned intermediate the circuit board and the first heat sink, and wherein a second electrically insulating layer is positioned intermediate the circuit board and the second heat sink.

* * * * *

UNITED STATES PATENT AND TRADEMARK OFFICE

CERTIFICATE OF CORRECTION

PATENT NO. : 7,946,732 B2
APPLICATION NO. : 12/355918
DATED : May 24, 2011
INVENTOR(S) : Hong Luo et al.

It is certified that error appears in the above-identified patent and that said Letters Patent is hereby corrected as shown below:

On the title page, the second inventor of item [75] Inventors:
Zhoahuan Liu, Mississauga (CA) should read
-- Zhaohuan Liu, Mississauga (CA) --.

On the title page, item [74] Attorney, Agent, or Firm:
Willaim E. Meyer; Shaun P. Montana; Yiming Zhang should read
-- William E. Meyer; Shaun P. Montana; Yiming Zhang --.

Signed and Sealed this
Twelfth Day of July, 2011

David J. Kappos

David J. Kappos
*Director of the United States Patent and Trademark Office*